US009768559B2

(12) United States Patent
Li et al.

(10) Patent No.: US 9,768,559 B2
(45) Date of Patent: Sep. 19, 2017

(54) SHIELD HOUSING AND SOCKET CONNECTOR

(71) Applicants: Tyco Electronics (Shanghai) Co. Ltd., Shanghai (CN); Tyco Electronics Nederland BV, AR 's-Hertogenbosch (NL)

(72) Inventors: Lizhou Li, Shanghai (CN); Hongqiang Han, Shanghai (CN); Wenyu Liu, Shanghai (CN); Yangrong Xue, Shanghai (CN); Chenxi Wang, Shanghai (CN); Rutger Wilhelmus Smink, AR s'Hertogenbosch (NL); Jacobus Nicolaasv Tuin, AR s'-Hertobenbosch (NL)

(73) Assignees: Tyco Electronics (Shanghai) Co. Ltd., Shanghai (CN); Tyco Electronics Nederland NV, S-Hertogenbosch (NL)

( * ) Notice: Subject to any disclaimer, the term of this patent is extended or adjusted under 35 U.S.C. 154(b) by 0 days.

(21) Appl. No.: 15/097,643

(22) Filed: Apr. 13, 2016

(65) Prior Publication Data

US 2016/0301166 A1 Oct. 13, 2016

(30) Foreign Application Priority Data

Apr. 13, 2015 (CN) ..... 2015 2 0219163

(51) Int. Cl.
*H01R 13/6582* (2011.01)

(52) U.S. Cl.
CPC ..... *H01R 13/6582* (2013.01)

(58) Field of Classification Search
IPC ..... H01R 13/6582
See application file for complete search history.

(56) References Cited

U.S. PATENT DOCUMENTS 6,257,935 B1 * 7/2001 Zhang ..... H01R 24/64 439/676
6,312,293 B1 * 11/2001 Wang ..... H01R 13/6275 439/607.01
6,319,070 B1 * 11/2001 Tan ..... H01R 24/64 439/607.43
6,354,884 B1 * 3/2002 Yeh ..... H01R 13/645 439/296
6,458,001 B1 * 10/2002 Chen ..... H01R 13/64 439/676
6,835,092 B2 * 12/2004 Wan ..... H01R 13/6658 439/541.5
6,923,689 B2 * 8/2005 Xue ..... H01R 24/64 439/490
7,168,985 B1 * 1/2007 Zhang ..... H01R 24/64 439/541.5
7,557,306 B2 * 7/2009 Chen ..... H05K 9/0058 174/377
7,862,378 B1 * 1/2011 Wan ..... H01R 13/506 439/607.35

(Continued)

*Primary Examiner* — Alexander Gilman
(74) *Attorney, Agent, or Firm* — Barley Snyder

(57) ABSTRACT

A shield housing for a socket connector is disclosed. The shield housing comprises a first vertical wall, a second vertical wall opposite to the first vertical wall, and an interface wall connected between the first and second walls and having a receiving opening for receiving a plug connector, inner edges of the interface wall being provided with a plurality of elastic sheets bent and extending inwardly.

18 Claims, 5 Drawing Sheets

(56) References Cited

U.S. PATENT DOCUMENTS

| | | | | |
|---|---|---|---|---|
| 8,152,564 | B2 * | 4/2012 | Chang | H01R 13/6658 439/607.01 |
| 8,535,098 | B2 * | 9/2013 | Chen | H01R 13/659 439/607.35 |
| 8,622,770 | B2 * | 1/2014 | Teo | G02B 6/4277 439/607.2 |
| 2009/0298338 | A1 * | 12/2009 | Zhang | H01R 23/6873 439/607.28 |

* cited by examiner

SHIELD HOUSING AND SOCKET CONNECTOR

CROSS-REFERENCE TO RELATED APPLICATIONS

This application claims the benefit of the filing date under 35 U.S.C. §119(a)-(d) of Chinese Patent Application No. 201520219163.9, filed on Apr. 13, 2015.

FIELD OF THE INVENTION

The present invention relates to a socket connector, and more particularly, to a socket connector comprising a shield housing for an electrical connector.

BACKGROUND

In a communication system, it is necessary to use an interface such as a known RJ45 connector to realize an electrical connection of communication lines. Generally, the RJ45 connector comprises a plug and a socket for receiving the plug. Improvement in electronic transmission speed of the RJ45 connector can be accomplished by improving electromagnetic interference (EMI) protection or a contact stability between the plug and the socket.

In order to improve the EMI protection performance, it is known in the art to provide as many elastic shield sheets as possible disposed on and electrically contacting the shield housing of the RJ45 socket connector. However, the shield housing of the socket connector is formed through punching and bending by a piece of metal, and the number of the shield elastic sheets formed by a conventional punching and bending method is restricted.

SUMMARY

An object of the invention, among others, is to provide a shield housing and a socket connector comprising the shield housing capable of shielding electrical signals transmitted at a higher speed and over a longer distance. The disclosed shield housing comprises a first vertical wall, a second vertical wall opposite to the first vertical wall, and an interface wall connected between the first and second walls and having a receiving opening for receiving a plug connector, inner edges of the interface wall being provided with a plurality of elastic sheets bent and extending inwardly.

BRIEF DESCRIPTION OF THE DRAWINGS

The invention will now be described by way of example with reference to the accompanying figures, of which.

DETAILED DESCRIPTION OF THE EMBODIMENT(S)

The invention is explained in greater detail below with reference to embodiments of a socket connector. This invention may, however, be embodied in many different forms and should not be construed as limited to the embodiments set forth herein; rather, these embodiments are provided so that this disclosure will be thorough and complete and still fully convey the scope of the invention to those skilled in the art.

A socket connector 100 according to the invention is shown in FIGS. 2-7. The socket connector 100 includes an insulation housing 1, a plurality of connection terminals 2, and a shield housing 3. The major components of the invention will now be described in greater detail.

Figure 2:
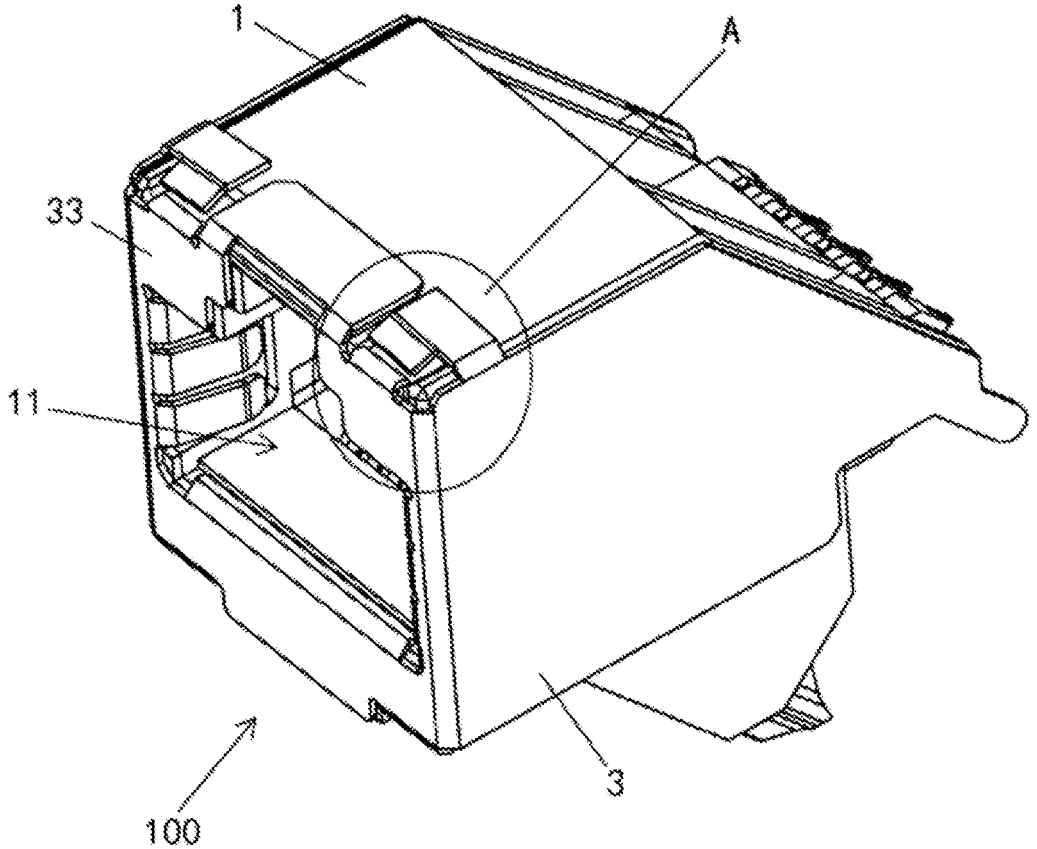
FIG. 2 is a perspective view of a socket connector according to the invention.
Figure 3:
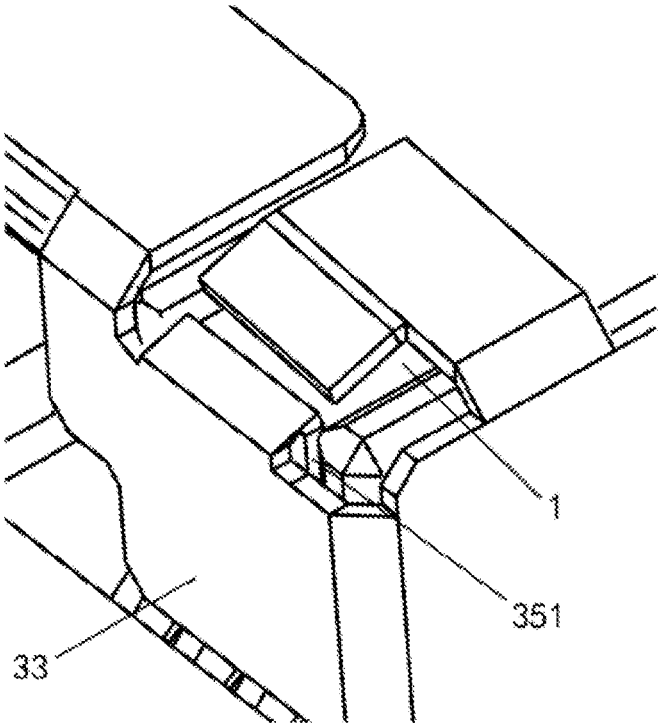
FIG. 3 is an enlarged view illustrating portion A shown in FIG. 2.
Figure 4:
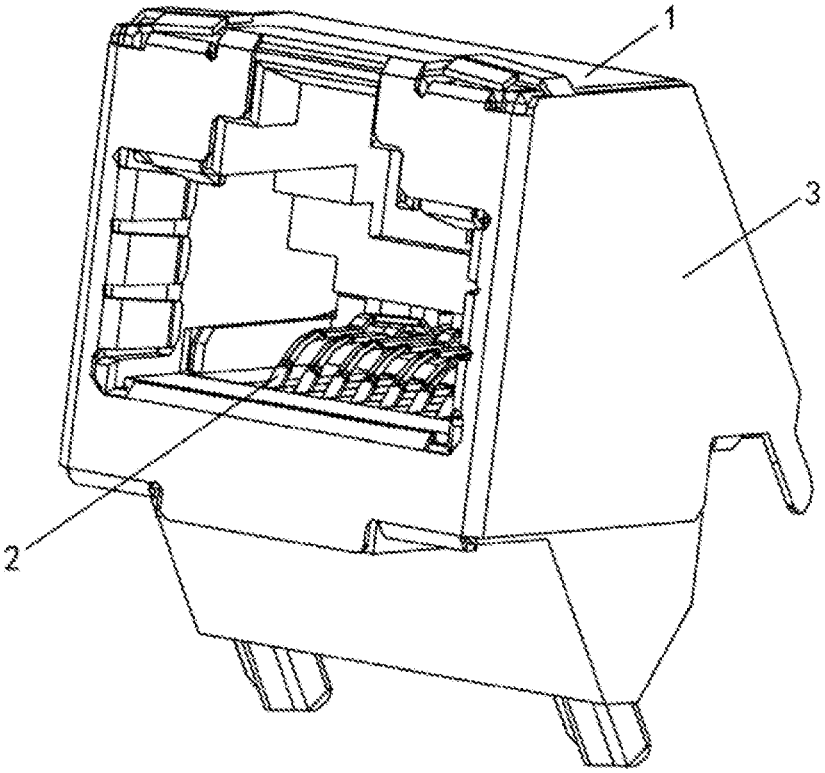
FIG. 4 is a perspective view of the socket connector shown in FIG. 2.
Figure 10:
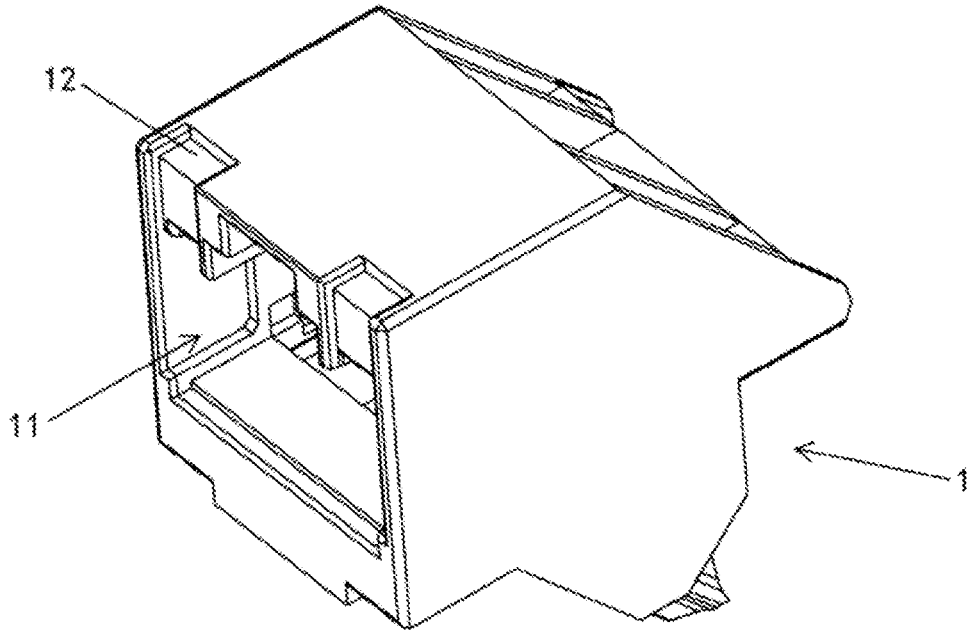
FIG. 10 is a perspective view of an insulation housing according to the invention.
Figure 11:
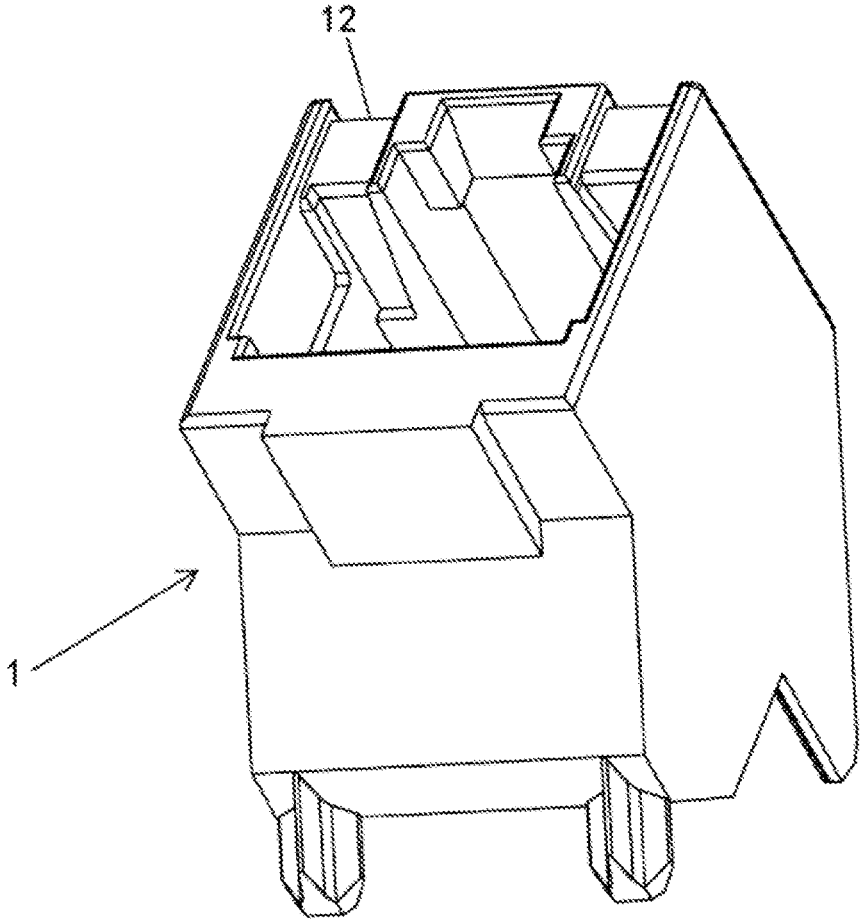
FIG. 11 is a perspective view of the insulation housing shown in FIG. 10.

The insulation housing 1 has a receiving chamber 11 as shown in FIG. 2. As shown in FIGS. 10 and 11, the upper wall of the insulation housing 1 is formed with receiving recesses 12. The plurality of connection terminals 2 are mounted in the receiving chamber 11, and may be any form of connection terminal known to those with skill in the art.

Figure 6:
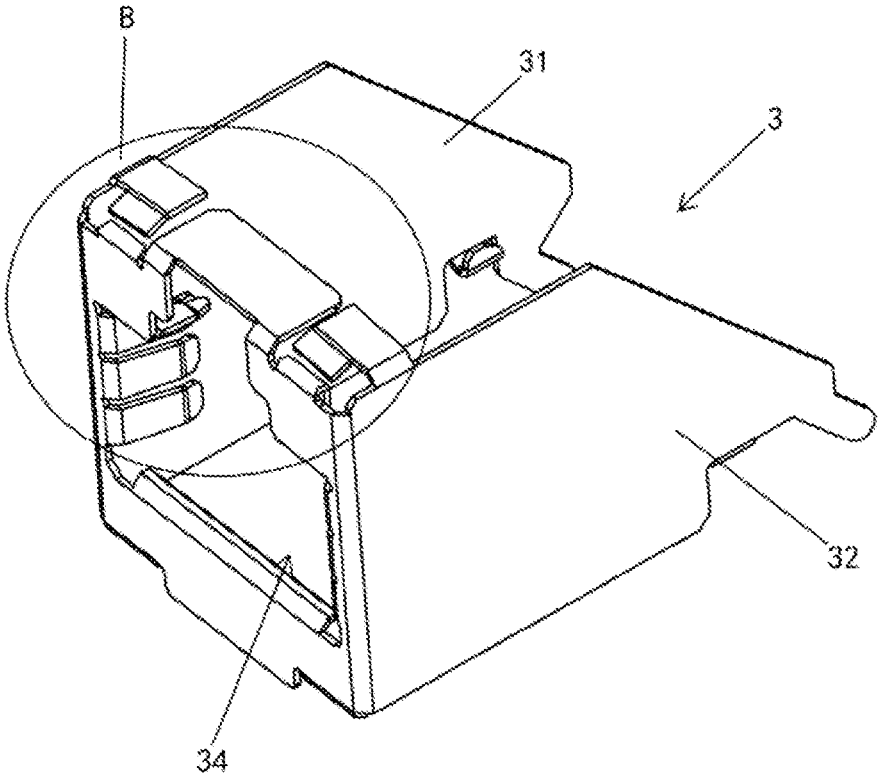
FIG. 6 is a perspective view of a shield housing according to the invention.
Figure 7:
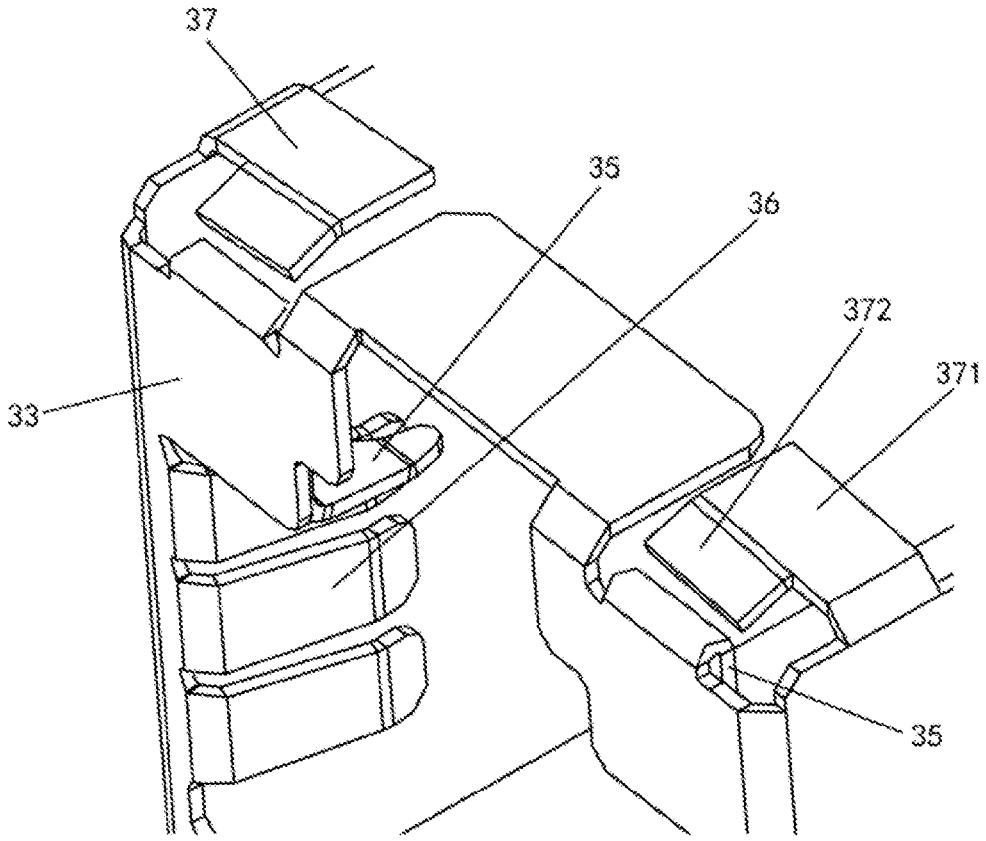
FIG. 7 is an enlarged view of portion B shown in FIG. 6.

The shield housing 3, as shown primarily in FIGS. 6 and 7, comprises a first vertical wall 31, a second vertical wall 32 opposite and parallel to the first vertical wall 31, and an interface wall 33 connected between the first and second walls 31, 32 and formed with a receiving opening 34. The shield housing 3 may be made of a sheet metal, for example a stainless steel, and may be formed by punching and bending.

Inner edges of the interface wall 33, as shown in FIG. 7, are provided with a plurality of elastic sheets extending inwardly by bending, including first elastic sheet 35, at least two second elastic sheets 36, at least two third elastic sheets (not shown), and two outer elastic sheets 37.

Figure 8:
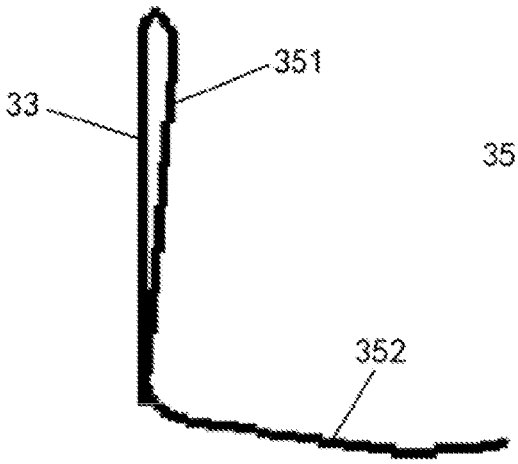
FIG. 8 is a section view of a first elastic sheet of the shield housing shown in FIG. 6.

As shown in FIG. 8, the first elastic sheet 35 has a substantial L-shaped section and includes first and second arms 351, 352 integrally connected with each other. The first arm 351 bends and extends from on outer edge of the interface wall 33 and is abutted against a surface of the interface wall 33, and the second arm 352 bends and extends substantially perpendicularly from the first arm 351 toward an interior of the receiving opening 34.

Figure 9:
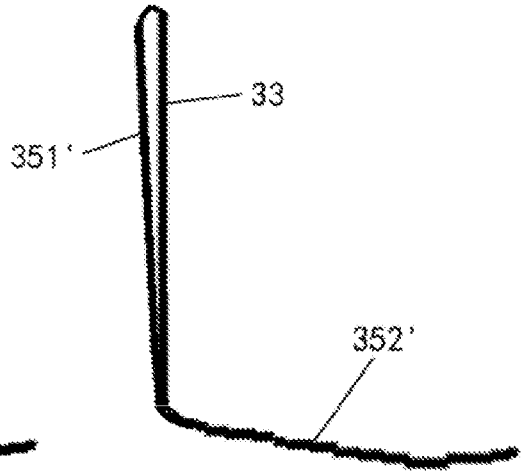
FIG. 9 is a section view of another embodiment of a first elastic sheet of the shield housing shown in FIG. 6.

In the embodiment illustrated in FIG. 8, the first arm 351 of the first elastic sheet 35 is abutted against an inner surface of the interface wall 33 to be sandwiched between the interface wall 33 and the insulation housing 1. That is, the first elastic sheet 35 is formed by bending inwardly and downwardly 180 degree at an upper edge of the interface wall 33, and then bending perpendicularly at the inner edge of the receiving opening 34. Since the first arm 351 of the first elastic sheet 35 is abutted against the surface of the interface wall 33, an elastic restoring force of the second arm 352 will be increased. In an alternative embodiment, as shown in FIG. 9, the first arm 351' of the first elastic sheet is abutted against an outside surface of the interface wall 33, and the second arm 352' is formed by extending inwardly over a lower edge of the interface wall 33.

Figure 5:
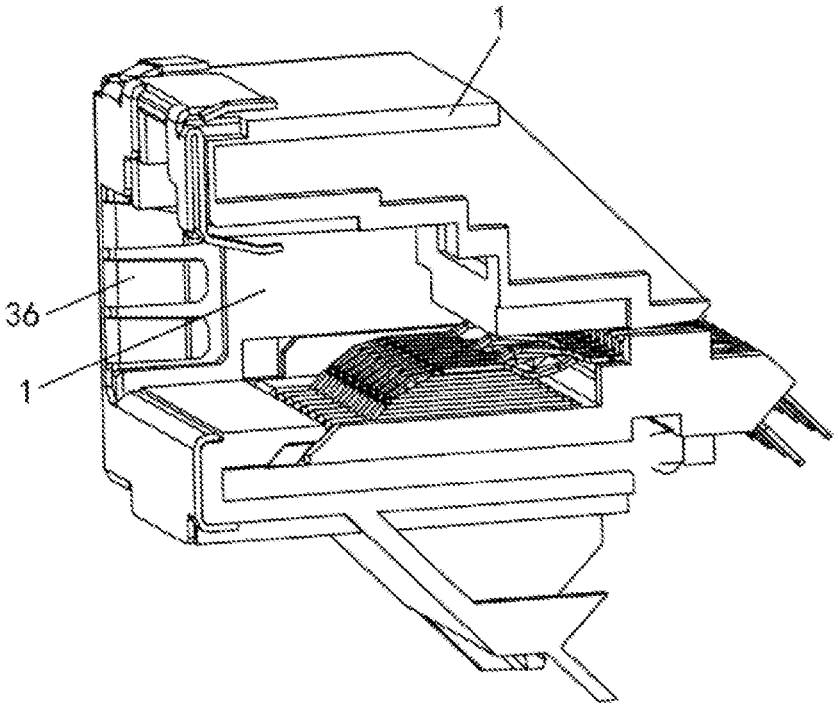
FIG. 5 is an axial section view of the socket connector shown in FIG. 2.

The at least two second elastic sheets 36, shown in FIGS. 5 and 7, are arranged side by side and extend obliquely inwardly relative to the first vertical wall 31. Similarly, the at least two third elastic sheets (not shown) are arranged side by side and extend obliquely inwardly relative to the second vertical wall 32. In an exemplary embodiment, the second and third elastic sheets both include three elastic sheets. The second and third elastic sheets are formed at end portions of the first and second vertical walls 31, 32 by bending inwardly.

The two outer elastic sheets 37, as shown in FIG. 7, extend perpendicularly inward at upper portions of the first and second vertical walls 31, 32 adjacent to the interface wall 33. Each outer elastic sheet 37 includes a primary elastic sheet 371 integrally connected with the first vertical wall 31 or the second vertical wall 32, and at least one secondary elastic sheet 372 extending obliquely from at least one side of front and back sides of the primary elastic sheets 371.

Referring to FIGS. 6 and 7, the first elastic sheet 35 is formed by bending from an upper edge of the interface wall 33, the second and third elastic sheets are formed by bending from front edges of the first and second vertical walls 31, 32, respectively, and the outer elastic sheets 37 are formed by bending from upper edges of the first and second vertical walls, respectively. In this way, it is possible to form the whole shield housing 3 through a machine process such as punching, shearing and bending by a single metal sheet, thereby simplifying the manufacturing process of the shield housing and reducing the manufacturing cost thereof.

The assembly of the socket connector 100 will now be described. The shield housing 3 is constructed to clad an exterior of the insulation housing 1, as shown in FIG. 2. Part of one of side walls of the insulation housing 1 is sandwiched between the first vertical wall 31 and the second elastic sheets 36, and a part of the other side wall of the insulation housing 1 is sandwiched between the second vertical wall 32 and the third elastic sheets (not shown). The receiving recesses 12 receive the outer elastic sheets 37. The assembled socket connector 100 may be an RJ45 interface.

The use of the socket connector 100 will now be described. According to an exemplary embodiment of the disclosure, the socket connector 100 mates with a plug connector 200 to realize an electrical connection of communication lines.

Figure 1:
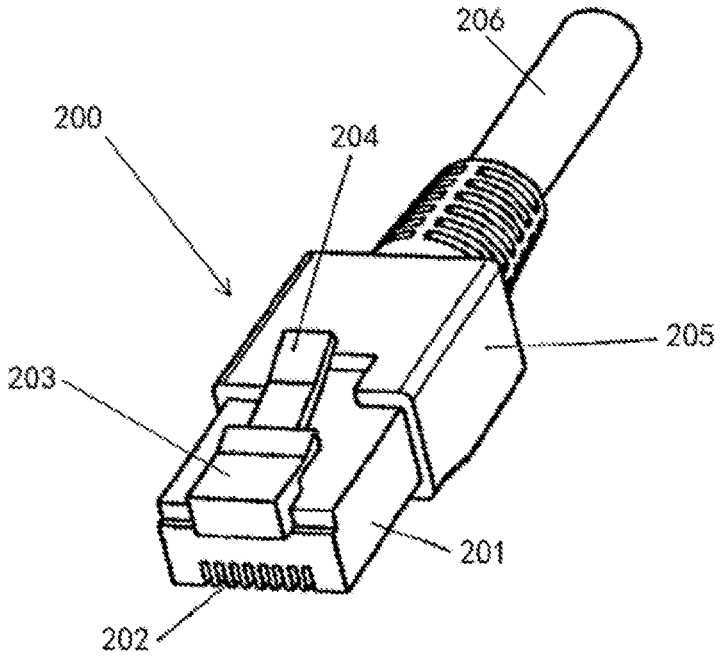
FIG. 1 is a perspective view of a plug connector according to the invention.

As shown in FIG. 1, the plug connector 200 includes a main body 202 having a substantially cuboid shape (also known as a crystal head), a plurality of connection terminals 202 mounted at a lower portion of the main body 201, a positioning portion 203 integrally formed at a middle position of an upper portion of the main body and protruding therefrom, a handling portion 204 connected on the positioning portion 203, a tail sleeve 205 sheathed over the main body 201, and a cable 206 electrically connected to the connection terminals 202. The plug connector 200 may be an RJ45 plug connector.

In an exemplary embodiment of the disclosure, the socket connector 100 is a RJ45 socket connector, and the plug connector 200 is a RJ45 plug connector. In this case, receiving chamber 11 of the socket connector 100 and the positioning portion 203 of the plug connector 200 both have a substantial-shape. The present embodiment is not so limited, it should be understood that the inventive concept of the disclosure is also suitable for other types of connectors.

The plug connector 200 is inserted into the receiving chamber 11 through the receiving opening 34. When inserted, the plurality of connection terminals 2 electrically connect with the connection terminals 202 of the plug connector 200.

The shield housing 3 electromagnetically shields the connection terminals 2 and the connection terminals 202. The first elastic sheet 35 elastically contacts with portions of the main body 201 located on either side of the positioning portion 203; the second arm 352 of the first elastic sheet 35 is deformed due to a press applied thereto by the main body 201. Since the first arm 351 connected to the second arm 352 is abutted against the surface of the interface wall 33, it is possible to increase an elastic contact force of the first elastic sheet 35 to the plug connector 200, which improves an EMI protection performance. The second elastic sheets 36 and third elastic sheets (not shown), by virtue of being positioned on a part of the side walls of the insulation housing 1, further increase the elastic contact force to the plug connector 200.

Additionally, it is possible to firmly mount the socket connector 100 on a mounting seat (not shown) by means of an elastic force of the outer elastic sheets 37. During mounting the socket connector 100 on the mounting seat (not shown), the outer elastic sheets 37 are pressed to be compressed into the recesses 12 by the mounting seat. It is possible to increase an elastic force of the outer elastic sheets 37 to firmly retain the socket connector on the mounting seat by providing a secondary elastic sheet 372.

Advantageously, in the shield housing 3 and the socket connector 100 according to various embodiments of the disclosure described above, through providing the first elastic sheet 35 having the substantial L-shape section, it is possible to increase the contact force of the first elastic sheet 35 applied to the plug connector 200 inserted into the socket connector 100 and improve the EMI protection performance, thereby satisfying requirements for shielding electrical signals transmitted at higher speed and longer distance.

What is claimed is:

1. A shield housing for a socket connector, comprising:

a first vertical wall;

a second vertical wall opposite to the first vertical wall; and an interface wall connected between the first and second walls and having a receiving opening for receiving a plug connector, inner edges of the interface wall being provided with a plurality of elastic sheets bent and extending inwardly, the plurality of elastic sheets including at least one first elastic sheet having a substantially L-shaped section and including a first arm bent and extending from an outer edge of the interface wall and abutted against a surface of the interface wall, and a second arm bent and extending substantially perpendicularly from the first arm toward an interior of the receiving opening.

2. The shield housing of claim 1, wherein the first arm of the first elastic sheet is abutted against an inside surface of the interface wall.

3. The shield housing of claim 1, wherein the plurality of elastic sheets further include at least two second elastic sheets arranged side by side and extending obliquely inward from the first vertical wall.

4. The shield housing of claim 3, wherein the plurality of elastic sheets further include at least two third elastic sheets arranged side by side and extending obliquely inward from the second vertical wall.

5. The shield housing of claim 4, wherein the plurality of second elastic sheets and the plurality of third elastic sheets both include three elastic sheets.

6. The shield housing of claim 1, further comprising two outer elastic sheets bent perpendicularly inward at positions adjacent to the interface wall at upper portions of the first and second vertical walls, respectively.

7. The shield housing of claim 6, wherein each outer elastic sheet includes a primary elastic sheet connected with the first or second vertical wall, and at least one secondary elastic sheet extending obliquely from a front side or a back side of the primary elastic sheet.

8. The shield housing of claim 1, wherein the first vertical wall, second vertical wall, and interface wall are integrally formed from a metal sheet.

9. A socket connector, comprising:

an insulation housing provided with a receiving chamber for receiving a plug connector;

a plurality of connection terminals mounted in the receiving chamber; and a shield housing disposed on an exterior of the insulation housing and including a first vertical wall, a second vertical wall opposite to the first vertical wall, and an interface wall connected between the first and second walls formed with a receiving opening for receiving a plug connector, inner edges of the interface wall being provided with a plurality of elastic sheets bent and extending inwardly, the plurality of elastic sheets including at least one first elastic sheet having a substantially L-shaped section and including a first arm bent and extending from an outer edge of the interface wall and abutted against a surface of the interface wall, and a second arm bent and extending substantially perpendicularly from the first arm toward an interior of the receiving opening.

10. The socket connector of claim 9, wherein the socket connector is a RJ45 socket connector.

11. The socket connector of claim 9, wherein the first arm of the first elastic sheet abuts against an inside surface of the interface wall and is disposed between the interface wall and the insulation housing.

12. The socket connector of claim 9, wherein the plurality of elastic sheets further include at least two second elastic sheets arranged side by side and extending obliquely inward relative to the first vertical wall, a part of one side wall of the insulation housing disposed between the first vertical wall and the second elastic sheets, and at least two third elastic sheets arranged side by side and extending obliquely inward relative to the second vertical wall, a portion of the other side wall of the insulation housing disposed between the second vertical wall and the third elastic sheets.

13. The socket connector of claim 12, wherein the second and third elastic sheets both include three elastic sheets.

14. The socket connector of claim 9, wherein the shield housing further includes two outer elastic sheets bent perpendicularly inward at positions adjacent to the interface wall at upper portions of the first and second vertical walls respectively, the two outer elastic sheets abutted against an outside of an upper wall of the insulation housing.

15. The socket connector of claim 14, wherein each outer elastic sheet includes a primary elastic sheet connected with the first or second vertical wall, and at least one secondary elastic sheet extending obliquely toward an upper portion of the insulation housing from a front side or a back side of the primary elastic sheet.

16. The socket connector of claim 15, wherein the outer elastic sheets are received in recesses of the upper wall of the insulation housing.

17. A connector assembly, comprising:

a plug connector including a main body having a substantial cubic shape and a positioning portion protruding from an upper side of the main body; and a socket connector including an insulation housing provided with a receiving chamber for receiving the plug connector, a plurality of connection terminals mounted in the receiving chamber, and a shield housing disposed on an exterior of the insulation housing including a first vertical wall, a second vertical wall opposite to the first vertical wall, and an interface wall connected between the first and second walls formed with a receiving opening for receiving the plug connector, inner edges of the interface wall being provided with a plurality of elastic sheets elastically contacting the main body at each side of the positioning portion, the plurality of elastic sheets including at least one first elastic sheet having a substantially L-shaped section and including a first arm bent and extending from an outer edge of the interface wall and abutted against a surface of the interface wall, and a second arm bent and extending substantially perpendicularly from the first arm toward an interior of the receiving opening.

18. The connector assembly of claim 17, wherein the socket connector is a RJ45 socket connector and the plug connector is a RJ45 plug connector.

* * * * *